US005520515A

United States Patent [19]

Bailey et al.

[11] Patent Number: 5,520,515

[45] Date of Patent: May 28, 1996

[54] VARIABLE PITCH PROPELLER HAVING LOCKING INSERT

[75] Inventors: Fred W. Bailey; Robert D. Low, both of Shreveport, La.

[73] Assignee: Bailsco Blades & Casting, Inc., Shreveport, La.

[21] Appl. No.: 447,816

[22] Filed: May 23, 1995

[51] Int. Cl.[6] ..... F04D 29/36

[52] U.S. Cl. ..... 416/208; 416/214 R

[58] Field of Search ..... 416/208, 214 R, 416/220

[56] References Cited

U.S. PATENT DOCUMENTS

| | | | |
|---|---|---|---|
| 813,074 | 2/1906 | Barber . | |
| 1,634,330 | 7/1927 | Malm . | |
| 1,790,844 | 2/1931 | Schultz | 416/208 |
| 2,307,490 | 1/1943 | Curley . | |
| 2,664,961 | 1/1954 | Goede . | |
| 2,918,977 | 12/1959 | Fedan et al. | 416/214 |
| 3,123,145 | 3/1964 | Byrd . | |
| 4,150,921 | 4/1979 | Wennberg . | |
| 4,265,591 | 5/1981 | Gurbin | 416/209 |
| 4,600,362 | 7/1986 | Vostermans | 416/208 |
| 4,605,355 | 8/1986 | Davis | 416/208 |
| 4,715,784 | 12/1987 | Mosiewicz | 416/208 |
| 4,930,989 | 6/1990 | Mosiewicz | 416/204 R |

FOREIGN PATENT DOCUMENTS

| | | | |
|---|---|---|---|
| 0713855 | 8/1954 | United Kingdom | 416/208 |
| 1085344 | 9/1967 | United Kingdom | 416/208 |

*Primary Examiner*—Edward K. Look
*Assistant Examiner*—Michael S. Lee
*Attorney, Agent, or Firm*—Cushman Darby & Cushman

[57] ABSTRACT

A variable pitch propeller has a two part hub assembly, each part of the hub has generally semi-cylindrical half sockets formed therein for receiving the cylindrical blade root shanks of individual fan blades. The sockets have enlarged portions, defining semi-annular shoulders, which receive an enlarged portion of the blade root shank so as to prevent axial movement of the fan blade. The half sockets of at least one part of the hub further have recessed portions for receiving locking insert members having a curved upper surface and a longitudinal keyway formed therein. A radially projecting key extends longitudinally along at least an a portion of the blade root shank and fits into the keyway formed in the locking insert member when the fan blade is placed into the half socket containing the locking insert member. The two parts of the hub assembly are coupled to clamp the fan blades within the aligned half sockets. With the key of the root shank disposed in the keyway of the locking insert member, pitch-wise rotation of the blade is prevented, the orientation of the keyway in the locking insert defining the pitch angle of the blade.

5 Claims, 6 Drawing Sheets

Fig. 8b
Fig. 8a
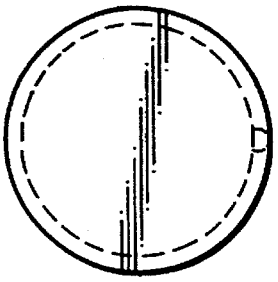
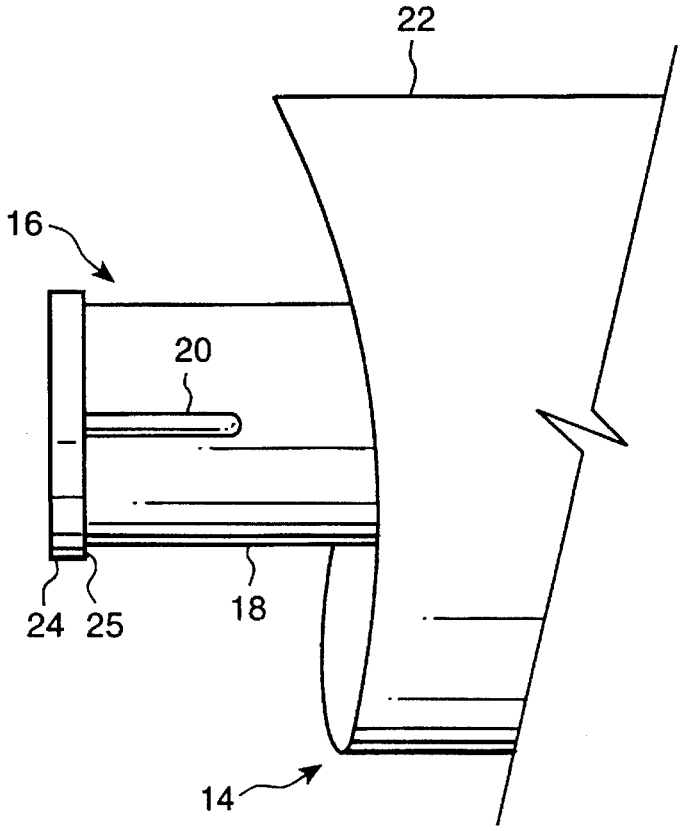
Fig. 8c
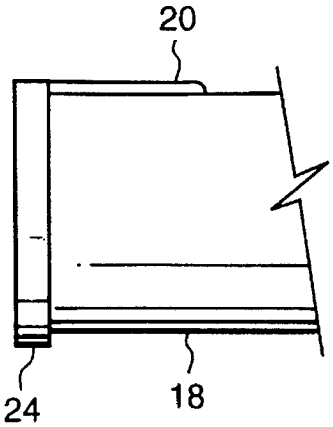

VARIABLE PITCH PROPELLER HAVING LOCKING INSERT

BACKGROUND OF THE INVENTION

1. Field of the Invention

The present invention relates to standard or reverse flow propellers having individual fan blades whose pitch may be varied and having a locking insert member, that is easily interchangeable, which sets the blade pitch and positively locks the blade to a desired pitch angle.

2. Description of the Related Art

It is often necessary to vary the pitch of the individual blades of a propeller in order to vary the performance characteristics of the propeller and/or to optimize the performance of the propeller relative to the output capabilities of the propeller's power source. Adjustable pitch propellers, using various devices for adjusting the pitch of the blades and locking the blades in a desired pitch position, have been known for a number of years.

For example, U.S. Pat. No. 1,790,844 discloses an adjustable pitch propeller blade having raised ribs extending from a tapered root shank of the blade. Split collars are clamped around the shank to hold each blade to a hub. The split collars have a series of notches on the interior portion of each half of the collar for receiving the ribs on the shank. Different blade pitch positions are achieved by placing the ribs on the shank into different notches in the collars. The blade is clamped to the hub when the two halves of the split collar are bolted together. The blade is retained in the hub axially by an elongated wedge that is inserted through a slot in the blade shank and openings in each half of the collar. This reference provides limited flexibility in blade pitch variation due to the fact that the collars are formed with a discreet number of slots into which the raised rib of the shank can be engaged. In addition, providing a number of slots in the split collars as well as a hole through the shank and the collars for receiving the elongated retaining wedge piece increases manufacturing complexity.

U.S. Pat. No. 3,123,145 discloses variable pitch blades in a hub which includes sockets for receiving the cylindrical shanks of each propeller blade. Both the sockets and the shanks have circumferentially spaced axial grooves formed therein. A key fits within the circumferentially spaced grooves in the root shank and the socket to fix the propeller blade in a desired pitch position. With the key removed, the blade can be rotated within the socket, and by aligning a specific groove in the shank with a specific groove in the socket, a desired pitch angle is achieved. The key is inserted into the aligned grooves to fix the blade in the desired pitch position. In addition, a set screw, extending into the socket perpendicularly to the blade root shank, further fixes the propeller blade in the desired pitch position. The arrangement disclosed in the reference requires complex machining to form the circumferentially spaced grooves in both the blade root shank and the socket. Moreover, pitch variation flexibility is limited due to the fact that there is a fixed number of discreetly spaced grooves formed in the blade root blade shank and the socket.

U.S. Pat. No. 4,600,362 discloses an adjustable pitch fan blade having an interchangeable locking means for fixing the blade in a desired pitch position. The locking means includes key pieces having two spaced projections on one side for engaging two corresponding recesses in the end surface of the blade root shank and two equally spaced projections on the other side of the key piece for engaging two corresponding recess provided in the base of the hub socket. Different key pieces, with varying positions of the two projections for engaging the recesses in the base of the root shank, are interchangeable to allow for different pitch settings of the fan blades. Further, an enlarged shoulder portion of the root shank fits into an enlarged portion of the socket to prevent axial movement of the fan blade when the propeller is assembled.

The key pieces disclosed in the U.S. Pat. No. '362 reference must be individually produced by using an adjustable mold, thereby inhibiting mass production of the key pieces. Furthermore, because the key piece of the reference engages only the end surface of the blade root shank, twisting of the shank is possible, especially where long shank lengths are required for large fan blades. Thus, the arrangement of this reference does not provide sufficient support to prevent pitch-wise rotation of the fan blade. Finally, the key projection, which is recessed into the hub bushing area, can create a potential weak area and potentially limits the assembled propeller diameter, particularly for large diameter propellers.

British Patent No. 713,855 discloses a propeller having a hub portion with a series of radially extending blade seating slots for receiving the root of individual propeller blades. The root shank of the propeller blade has a neck portion of a generally smaller diameter and an enlarged shoulder for engaging an inwardly facing edge of the blade socket. The neck portion has a flatten portion formed on its outer surface. A pitch plate, which slides into the socket perpendicularly to the blade root shank, has a straight edge that abuts against the flat portion of the blade root shank. The pitch of the blade is set by the angle of the straight abutting edge of the pitch plate, and the pitch plate is secured into the hub by a series of screws, thus fixing the blade at the desired pitch angle. The pitch of a blade is varied by substituting a different pitch plate having an abutting edge of a different angular orientation. Due to the fact that the pitch plate contacts a relatively localized portion of the blade root shank, localize stresses on both the blade root shank and the pitch plate, at their respective points of contact, can be extremely high, thus increasing the danger of material failure.

Finally, British Patent No. 1,085,344 discloses an adjustable pitch propeller blade in which the blade root, having an enlarged shoulder at its end, fits into a socket formed to receive the root. A hexagonally shaped key piece fits into a matting opening at the base of the socket. A rectangular projection or key extends from the key piece into a slot in the end of the blade root shank. The key and slot engagement between the key piece and the blade root prevents pitch wise rotation of the blade relative to the hub. Different key pieces having keys of different angular orientations can be used to fix the blades into different positions. The hexagonal shape of the key piece, as well as the hexagonal shape of the portion of the socket that receives the key piece, introduces substantial complexity into the hub fabrication process. In addition, as noted above, because the pitch wise locking of the blade occurs only at the end face of the blade root shank, twisting of the blade root shank is a possibility, especially in applications where a long shank is required.

As is apparent from the above, the need exists for a mechanism, to both set and fix the pitch position of an individual fan blade in a variable pitch propeller, which is easily fabricated, easily interchangeable, and provides positive locking along the entire length of the root shank of the propeller blade to be adjusted.

SUMMARY OF THE INVENTION

It is an object of the present invention to provide a variable pitch propeller in which the mechanism for setting and locking an individual blade in a desired pitch position is easily interchangeable, is easily fabricated, provides wide flexibility in setting a desired blade pitch position, and provides positive locking along the entire root shank of the blade to be fixed.

The foregoing and other objects are achieved by providing a variable pitch propeller comprising, a hub assembly which comprises: first and second hub portions each having a plurality of half sockets formed therein. The half sockets of one of the hub portions further include a recessed portion formed therein. The first hub portion is selectively coupled to the second hub portion so that the half sockets of the first hub portion align with the half sockets of the second hub portion to form a plurality of blade sockets.

A fan blade extends from each of the plurality of blade sockets and is clamped therein when the first hub portion is coupled to the second hub portion. Each fan blade comprises a foil portion and a cylindrical blade root shank extending axially from an end of the foil portion, the blade root shank having a key projecting radially from the blade root shank and extending longitudinally along at least a portion of the blade root shank.

Finally, a locking insert member is disposed in each recessed portion. The locking insert member has a longitudinal keyway formed therein for receiving the key projecting from the blade root shank when the blade root shank is placed into the half socket containing the locking insert member, thereby determining pitch of the fan blade and preventing pitch-wise rotation of the fan blade when the fan blade is clamped between the first and second hub portions.

The locking inserts may be easily interchanged by simply removing the second hub portion from the first portion, lifting each fan blade out of each half socket of the first hub portion, and replacing the locking insert disposed in the recessed portions. In this manner, blade pitch can be easily varied by substituting a locking insert having a keyway formed at a different orientation.

The locking insert members can be mass produced by extruding a length of aluminum having the proper width, height, shape, and keyway orientation and then cutting the length of aluminum into desired lengths to create individual locking insert members. Also, the insert member can be fabricated with a keyway oriented in any position, thus providing flexibility in blade-pitch positioning.

Other objects, features, and characteristics of the present invention will become apparent upon consideration of the following description and the appended claims with reference to the accompanying drawings, all of which form a part of the specification, and wherein like reference numerals designate corresponding parts in the various figures.

BRIEF DESCRIPTION OF THE DRAWINGS

FIG. 8*a* is an end view of a fan blade root shank according to the present invention;

FIG. 8*b* is a partial plan view of the fan blade including the root shank;

FIG. 8*c* is a partial elevational view of the fan blade root shank; and

DETAILED DESCRIPTION OF THE PRESENTLY PREFERRED EXEMPLARY EMBODIMENT

Figure 1:
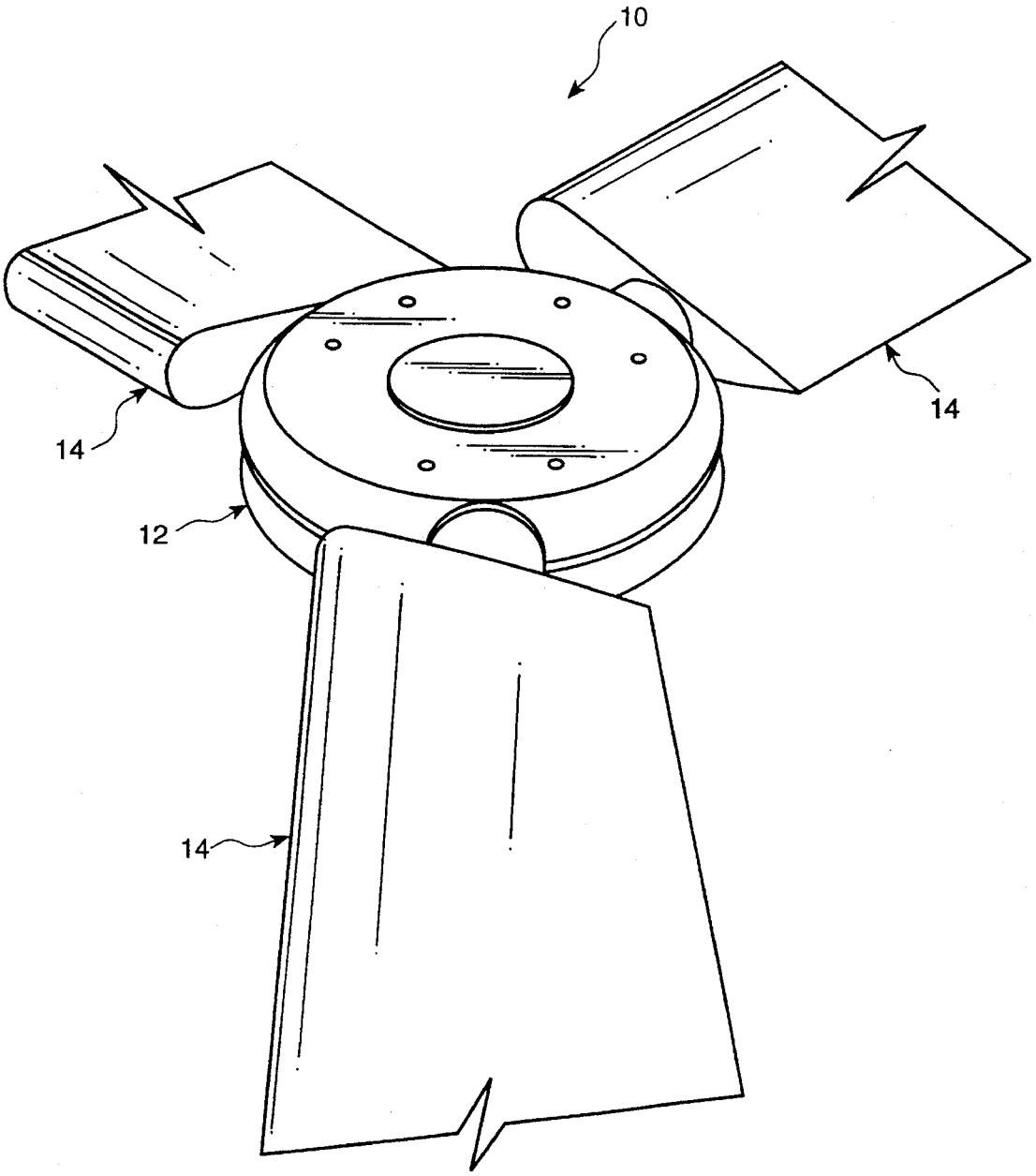
FIG. 1 is a partial perspective view of a variable pitch propeller.

A variable pitch propeller in accordance with the present invention is generally indicated in FIG. 1 by reference number 10. The propeller 10 includes a hub assembly 12 and a plurality of fan blades 14 secured to and extending outwardly from the hub assembly 12. The hub assembly 12 also functions as a structure for fixing the propeller 10 to a drive shaft (not shown) for rotating the propeller 10.

Figure 2:
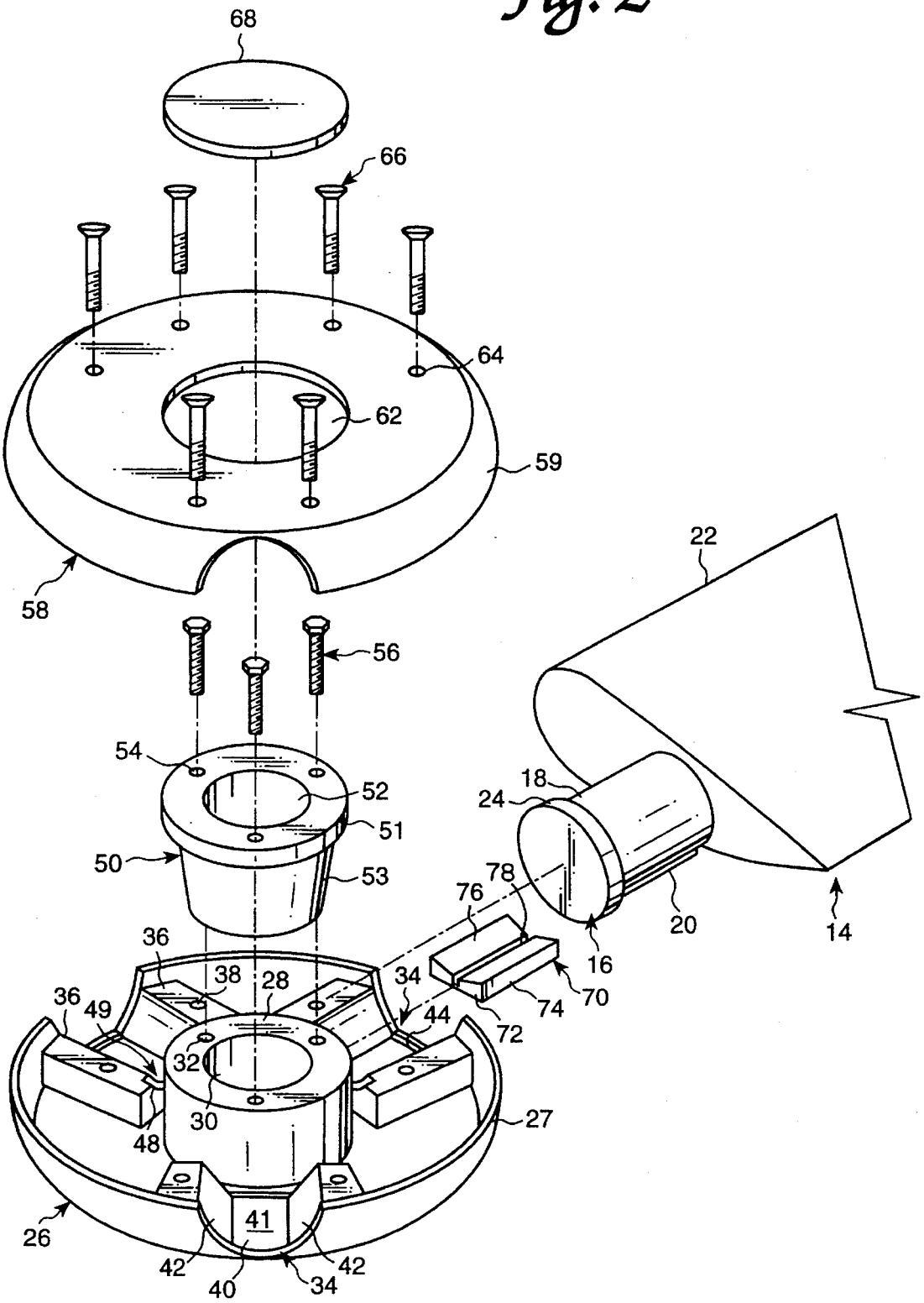
FIG. 2 is an exploded perspective view depicting a propeller hub, a single fan blade, and a locking insert according to the present invention.

An exploded view of the hub assembly 12 and a single fan blade 14 held therein is shown in FIG. 2. The fan blade 14 has a foil portion 22 and a blade root shank 16. The foil portion 22 will have a span length, chord length, thickness, and camber that are suitable for a particular propeller application.

As shown in FIGS. 2 and 8*a*–8*c*, the blade root shank 16 has a cylindrical barrel portion 18, a key 20 projecting radially from and extending longitudinally along the barrel portion 18, and an enlarged cylindrical head 24 defining a shoulder 25 at an end of the barrel portion 18 opposite the foil portion 22. The key 20 will extend along at least a portion of the length of the barrel portion 18 of the root shank 16. The length, width, and height of key 20 will vary depending upon a number of considerations, such as the strength of the material employed and the expected loads to which the propeller will be subjected. The relative dimensions shown in the figures are merely illustrative.

The fan blade 14 is preferably formed by integrally molding the foil portion 22, barrel portion 18, key 20, and head 24 although one or more of the components may be separately formed and later assembled. The fan blade is preferably made of aluminum or plastic or any other material that is preferably lightweight and has sufficient strength and stiffness to withstand the centrifugal and fluid dynamic loads to which the fan blade will be subjected.

The size, i.e., the length and diameter, of the blade root shank 16 will depend, in particular, on blade size and application. Exemplary test blades have been produced in which a fan blade having a 5" chord length has a 1¼" diameter root shank and a fan blade having a 7½" chord length has a 2½" diameter root shank.

As shown in FIG. 2, the hub assembly 12 includes a first or lower hub portion 26 and a second or upper hub portion 58. The lower hub portion 26 has an outer wall 27 and a cylindrical center portion 28 surrounding a center opening 30. The hub assembly 12 may be secured to a drive shaft (not shown) in a known manner by means of a conventional steel tapered bushing 50. The tapered bushing 50 has a tapered portion 53, that slides into the center opening 30, and a shaft hole 52, through which a drive shaft (not shown) extends. The tapered bushing 50 further has an annular flange 51 through which a plurality of fastening holes 54 are defined. The fastening holes 54 correspond with bolt holes 32 in the cylindrical center portion 28 of the lower hub portion 26. With the tapered portion 53 seated in the center opening 30 and the shaft extending through the center opening 52, the bushing 50 is fastened to the lower hub portion by means of bolts 56 extending through holes 54, and threaded into holes 32. As the bolts 56 are tightened, the tapered portion 53 will clamp the drive shaft to fix the bushing 50, and thus the lower hub portion 26, to the shaft.

As shown in FIGS. 2–5, the lower hub portion 26 also has a plurality of circumferentially spaced half sockets 34 formed therein for receiving the blade root shank 16 of each of a corresponding number of fan blades 14 as will be described below. The half sockets 34 include generally semicircular openings cut out of or otherwise defined in the outer wall 27 of the lower hub portion 26. Each half socket 34 of the lower hub portion 26 includes sidewall portions 42. As show in the illustrated embodiment, the sidewall portions 42 are each preferably curved to correspond to the cylindrical shape and size of the barrel portion 18 of the blade root shank 16. The sidewall portions 42 may, however, be multifaceted surfaces, such as surfaces that are semi-hexagonal or semi-octagonal in cross-section, that approximate the cylindrical surface of the barrel portion 18 of the blade root shank 16.

Each half socket 34 further has a recessed portion 40 having a flat bottom surface 41, an end wall 44, and side walls 43. The side walls 43 may be perpendicular with respect to the bottom surface 41, or they may be inclined as shown in the illustrated embodiment of FIGS. 4 and 5.

Figure 3:
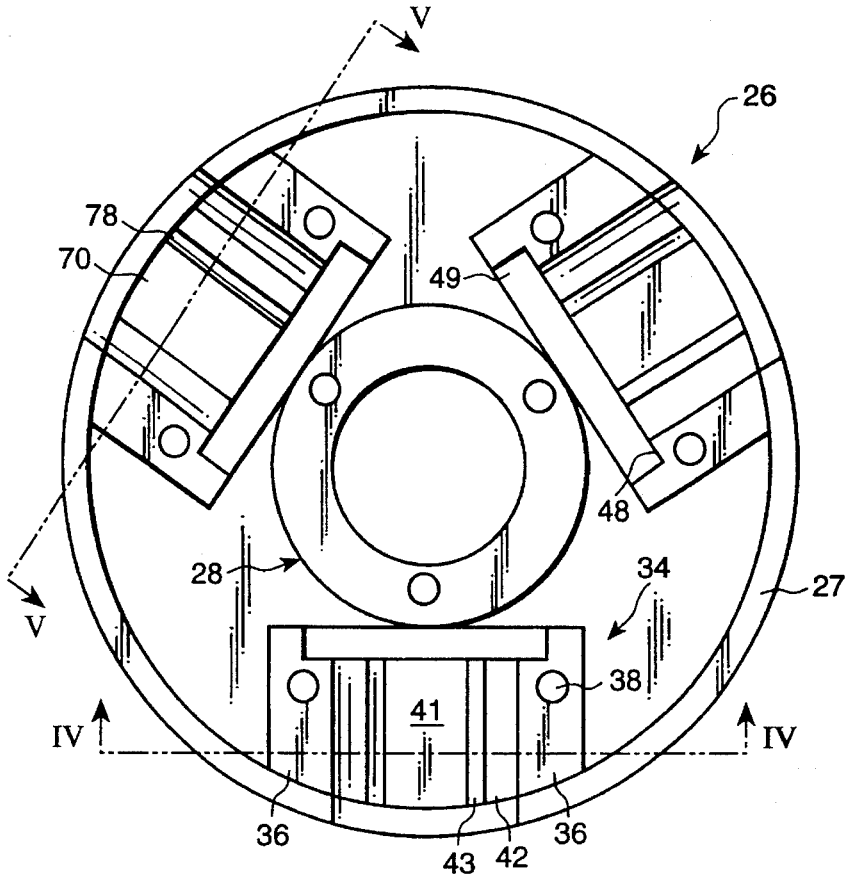
FIG. 3 is a plan view of an exemplary first hub portion.
Figure 4:
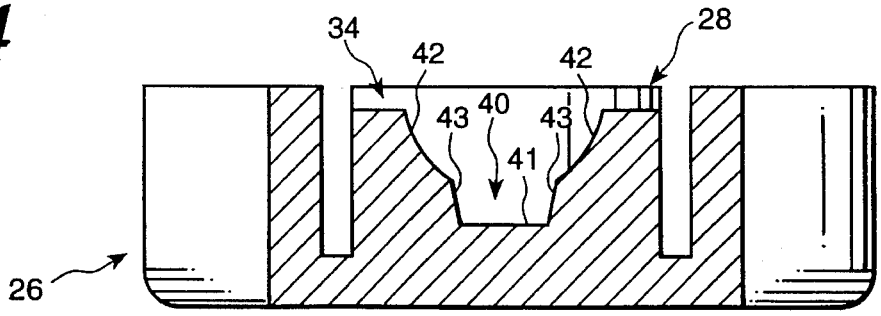
FIG. 4 is an elevational section of FIG. 3, viewed in the direction of line IV—IV.

As shown in FIGS. 2 and 3, each half socket preferably also has an enlarged semi-cylindrical portion 49 that defines a semi-annular shoulder 48 facing toward the center portion 28. The enlarged portion 49 receives the enlarged cylindrical head 24 of the blade root shank 16.

The lower hub portion 26 is preferably formed by integrally molding the center portion 28, the outer wall 27, and the half sockets 34 as a single piece. However, one or more of the parts may be separately formed and later assembled.

Figure 5:
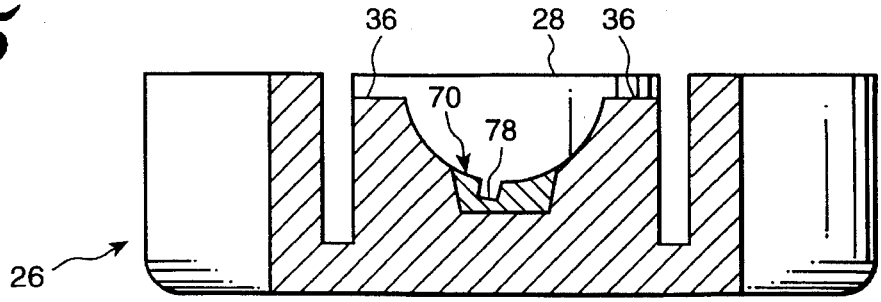
FIG. 5 is an elevational section of FIG. 3, viewed in the direction of line V—V.

As shown in FIGS. 3 and 5, each recessed portion 40 receives a respective blade locking insert member 70. Although FIG. 3 shows a locking insert member 70 disposed in the recessed portion of only one half socket 34, it is to be understood that each recessed portion will receive a locking insert member.

The length and width of the locking insert member 70 are preferably such that the locking insert fits snugly, within the recessed portion 40, between the side walls 43, the end wall 44, and the center portion 28.

The locking insert member 70 has side surfaces 74 (see FIGS. *9a–9c*) shaped to correspond with the side walls 43 of the recessed portion 40, a flat bottom 73, and end walls 72. The top surface 76 is preferably curved to accommodate the curvature of the barrel portion 18 of the blade root shank 16 but may be multi-faceted to approximate the shape of the barrel portion 18. With the locking insert member 70 placed into the recessed portion 40 of the half socket 34, the sidewall portions 42 of the half socket and the top surface 76 of the locking insert member preferably form a nearly continuous surface to accommodate the cylindrical surface of the barrel portion 18 of the root shank 16. Finally, the insert member 70 has formed therein a keyway 78 which receives the key 20 of the root shank 16 for setting the pitch of the fan blade 14 and for preventing pitch-wise rotation of the fan blade 14 when the propeller 10 is assembled.

Figure 6:
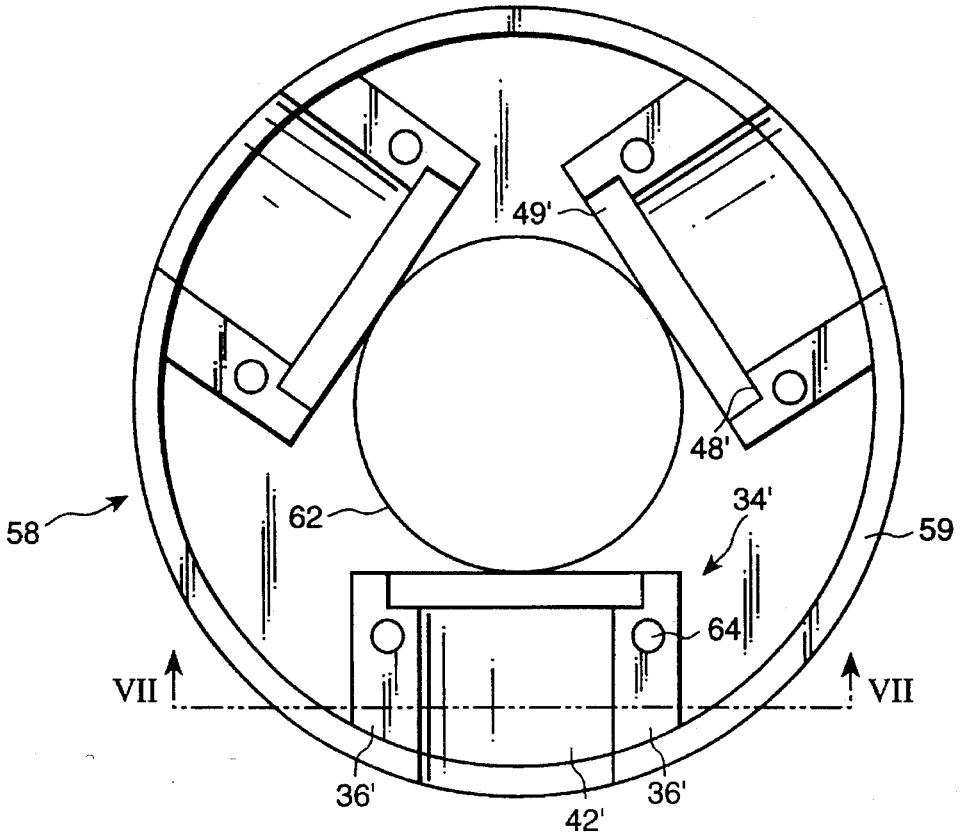
FIG. 6 is a plan view of an exemplary second hub portion.
Figure 7:
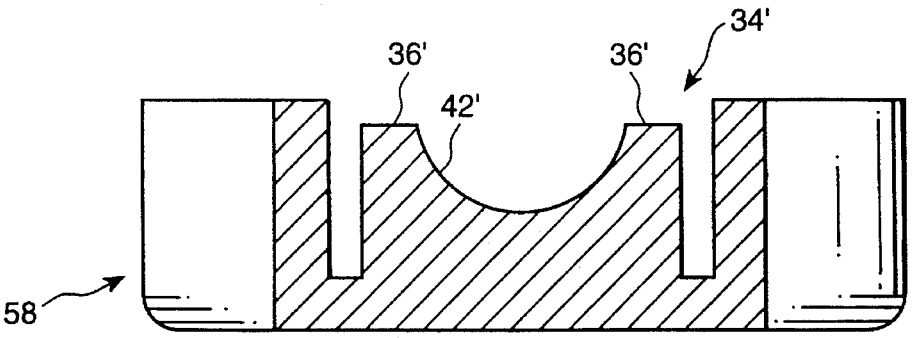
FIG. 7 is an elevational section of FIG. 6, viewed in the direction of line VII—VII.

As shown in FIGS. 6 and 7, the second or upper hub portion 58 has an outer wall 59, a center opening 62, and a plurality of half sockets 34' formed therein corresponding to the plurality of half sockets 34 formed in the lower hub portion 26. The half sockets 34' of the upper hub portion 58 are essentially identical to the half sockets 34 formed in the lower hub portion 26. Each half socket 34' has a sidewall portion 42' that is preferably curved (as shown in the illustrated embodiment) to correspond to the shape and size of the barrel portion 18 of the blade root shank 16 but may be multifaceted to approximate the shape of the barrel portion 18. Each half socket 34' also includes a semicircular opening cut out of or otherwise defined in the side wall 59.

As shown in FIG. 6, each half socket 34' preferably also has an enlarged semi-cylindrical portion 49' that defines a semi-annular shoulder 48' facing toward the center opening 62. The enlarged portion 49' receives the enlarged cylindrical head 24 of the blade root shank 16.

The upper hub portion 58 is preferably formed by integrally molding the outer wall 59 and the half sockets 34' as a single piece. However, one or more of the parts may be separately formed and later assembled.

The upper and lower hub portions 58, 26 are preferably made of a lightweight metal, such as aluminum.

In the preferred embodiment shown in FIGS. 6 and 7, the half sockets 34' of the upper hub portion 58 are shown without a recessed portion for receiving a locking insert member, such as recessed portion 40 formed in each half socket 34 of the lower hub portion 26. Possible alternate embodiments of the present invention, not shown, include a hub assembly in which the upper and lower hub portions both include half sockets having recessed portions for receiving locking insert members or an assembly in which the half sockets of the upper hub portion alone have recessed portions formed therein.

The purpose of the center opening 62 is to permit access to the tapered bushing 50 when the upper hub portion 58 is coupled to the lower hub portion 26. A closure piece 68 is preferably provided to prevent foreign objects from entering the hub assembly 12. It is contemplated that the closure piece 68 will be constructed of plastic for most applications or metal for high temperature applications. It is further contemplated that a plastic closure piece would be held in place by means of a friction snap-in structure. Alternatively, it is contemplated that a metal closure piece would be held in place by means of a rotary locking structure comprising tabs extending from the back side of the closure piece and mating radial slots formed in the upper hub portion extending from the center opening 62.

Assembly of the variable pitched propeller according to the present invention will now be described.

The propeller 10 is assembled by first placing a locking insert member 70 into the recessed portion 40 of each of the half sockets 34 of the lower hub portion 26. Next, the root shank 16 of each fan blade is placed in each of the sockets 34 atop the locking insert member 70 with the projecting key 20 of each root shank fitting into the keyway 78 of each locking insert member 70. The enlarged cylindrical head 24 of the blade root shank 16 fits into the enlarged semi-cylindrical portion 49 of the socket 34 such that the inwardly facing shoulder 48 of the socket is abutted by the annular shoulder 25 to prevent axial movement of the fan blade 14.

With a locking insert 70 and a blade root shank 16 placed in each half socket 34, the upper hub portion 58 is placed over the lower hub portion 26 with its half sockets 34' aligned with the half sockets 34 of the lower hub portion 26.

The half sockets 34 of the lower hub portion 26 preferably have an enlarged attachment portion 36 on either side of the half socket 34 with threaded holes 38 disposed therein. Similarly, the half sockets 34' of the upper hub portion 58 also have enlarged attachment portions 36' on either side of the half socket 34' with holes 64 therethrough. The two hub portions are preferably fastened together by means of bolts 66 extending through holes 64 and threaded into holes 38.

With the two hub portions thus fastened together, the locking insert members 70 and blade root shanks 16 are clamped together within the half sockets 34, 34'. The locking insert member, having a flat bottom portion 73 setting atop the flat bottom portion 41 of the recessed portion 40 and fitting snugly therein, cannot slide or otherwise move within the socket. Accordingly, the blade root shank 16, with its projecting key 20 engaged with the keyway 78, cannot rotate about its longitudinal axis, and thus, the pitch of the fan blade 14 is fixed.

Figure 9A:
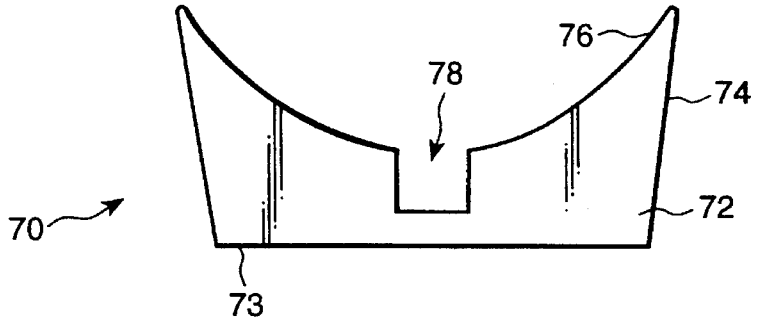
FIGS. 9*a*–9*c* are end views of locking inserts depicting different keyway orientations according to the present invention.
Figure 9B:
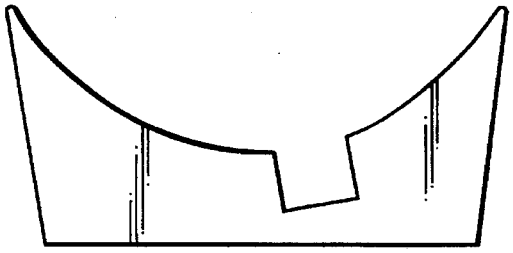
Figure 9C:
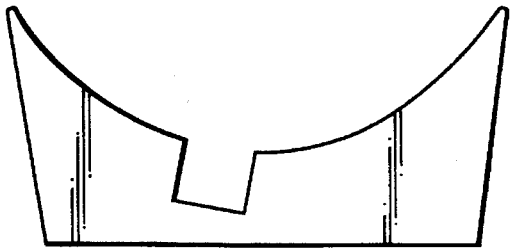

The pitch of the fan blade can be varied by using a locking insert having a keyway cut in a different angular location along the top surface 76 of the locking insert member 70. Representative examples of locking insert members, with keyways formed at different angular positions, are illustrated in FIGS. 9*a*–9*c*.

The locking inserts members are preferably made from extruded aluminum. An elongated portion of aluminum is extruded having the proper width, top surface curvature, and keyway orientation. Individual locking inserts are then made by cutting lengths of the extruded aluminum to proper dimension.

While the invention has been described in connection with what is presently considered to be the most practical and preferred embodiments, it is to be understood that the invention is not to be limited to the disclosed embodiments, but, on the contrary, it is intended to cover various modifications and equivalent arrangements included within the spirit and scope of the appended claims.

Thus, it is to be understood that variations in the particular parameters used in defining the variable pitch propeller with locking insert can be made without departing from the novel aspects of this invention as defined in the claims.

What is claimed is:

1. A variable pitch propeller comprising:

a hub assembly comprising:

first and second hub portions, each of said first and second hub portions having a plurality of generally semi-cylindrical half sockets formed therein, each said half socket of at least one of said first and second hub portions having a recessed portion formed therein, said first hub portion being selectively coupled to said second hub portion so that said half sockets of said first hub portion align with said half sockets of said second hub portion to form a plurality of blade sockets;

a fan blade extending from each of said plurality of blade sockets and being clamped therein when said first hub portion is coupled to said second hub portion, said fan blade comprising:

a foil portion; and a cylindrical blade root shank extending axially from an end of said foil portion, said blade root shank having a key projecting radially from said blade root shank and extending longitudinally along at least a portion of said blade root shank; and a locking insert member disposed in each said recessed portion, said locking insert member having a longitudinal keyway formed therein for receiving said key projecting from said blade root shank when said blade root shank is placed into said half socket containing said locking insert member, thereby determining pitch of said fan blade and preventing pitch-wise rotation of said fan blade when said fan blade is clamped between said first and second hub portions.

2. The propeller of claim 1 wherein each of said plurality of half sockets further includes an enlarged cylindrical portion defining an inwardly facing semi-annular shoulder and each said blade root shank further includes an enlarged cylindrical head defining an annular shoulder, said inwardly facing shoulders of said half sockets of said first hub portion aligning with said inwardly facing shoulders of said half sockets of said second hub portion when said first and second hub portions are coupled, said annular shoulder of said blade root shank abutting said inwardly facing shoulders of said half sockets of said first and second hub portions to prevent axial movement of said fan blade when said blade root shank is clamped between said first and second hub portions.

3. The propeller of claim 1 further including a tapered bushing for coupling said first hub portion to a drive shaft.

4. The propeller of claim 3 wherein said second hub portion provides a center opening to permit access to said tapered bushing and said second hub portion further includes a closure piece to cover said center opening when said propeller is assembled.

5. The propeller of claim 1 wherein said first and second hub portions are coupled together by means of threaded fasteners.

* * * * *